US012624413B2

(12) United States Patent
Yoshioka et al.

(10) Patent No.: US 12,624,413 B2
(45) **Date of Patent: *May 12, 2026**

(54) STEEL SHEET, MEMBER, AND METHOD FOR PRODUCING STEEL SHEET, AND METHOD FOR PRODUCING MEMBER

(71) Applicant: JFE STEEL CORPORATION, Tokyo (JP)

(72) Inventors: Shimpei Yoshioka, Tokyo (JP); Shinjiro Kaneko, Tokyo (JP); Yuma Honda, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 58 days.

This patent is subject to a terminal disclaimer.

(21) Appl. No.: 18/550,132

(22) PCT Filed: Feb. 28, 2022

(86) PCT No.: PCT/JP2022/008469
§ 371 (c)(1),
(2) Date: Sep. 12, 2023

(87) PCT Pub. No.: WO2022/209520
PCT Pub. Date: Oct. 6, 2022

(65) Prior Publication Data

US 2024/0175102 A1 May 30, 2024

(30) Foreign Application Priority Data

Mar. 31, 2021 (JP) ..... 2021-062254

(51) Int. Cl.
*C22C 38/00* (2006.01)
*C21D 1/18* (2006.01)
(Continued)

(52) U.S. Cl.
CPC ..... *C21D 9/46* (2013.01); *C21D 1/18* (2013.01); *C21D 1/84* (2013.01); *C21D 6/002* (2013.01);
(Continued)

(58) Field of Classification Search
CPC ..... C21D 2211/008; C22C 38/001; C22C 38/002; C22C 38/005; C22C 38/008;
(Continued)

(56) References Cited

U.S. PATENT DOCUMENTS 10,329,635 B2 6/2019 Shibata et al.
2018/0023154 A1 1/2018 Hasegawa et al.
(Continued)

FOREIGN PATENT DOCUMENTS

CN 102822375 A 12/2012
JP 2010215958 A 9/2010
(Continued)

OTHER PUBLICATIONS

Kinugasa et al., WO 2018123356 Google Patents machine translation printed Mar. 13, 2025, Nov. 21, 2017, entire translation (Year: 2017).*
(Continued)

*Primary Examiner* — Katherine A Christy
(74) *Attorney, Agent, or Firm* — KENJA IP LAW PC

(57) ABSTRACT

A steel sheet including: a chemical composition containing, by mass %, C: 0.12-0.40%, Si: 1.5% or less, Mn: more than 1.7% and 3.5% or less, P: 0.05% or less, S: 0.010% or less, sol. Al: 1.00% or less, N: 0.010% or less, Ti: 0.002-0.080%, and B: 0.0002-0.0050%, with the balance being Fe and inevitable impurities; a metallic structure in which an area ratio of martensite to an entire microstructure is 85% or more, and a ratio $L_S/L_B$ satisfies a predetermined formula (1), where $L_S$ denotes a length of a sub-block boundary and
(Continued)

$L_B$ denotes a length of a block boundary; and a tensile strength of 1310 MPa or more.

6 Claims, 2 Drawing Sheets

(51) Int. Cl.

| | |
|---|---|
| ***C21D 1/84*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 8/0278*** | (2026.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/16*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C22C 38/60*** | (2006.01) |

(52) U.S. Cl.
CPC ..... *C21D 6/005* (2013.01); *C21D 6/008* (2013.01); *C21D 8/02* (2013.01); *C21D 8/0226* (2013.01); *C21D 8/0236* (2013.01); *C21D 8/0263* (2013.01); *C21D 8/0278* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C22C 38/22* (2013.01); *C22C 38/26* (2013.01); *C22C 38/28* (2013.01); *C22C 38/32* (2013.01); *C22C 38/38* (2013.01); *C22C 38/60* (2013.01); *C21D 2211/008* (2013.01)

(58) Field of Classification Search
CPC ..... C22C 38/02; C22C 38/04; C22C 38/06; C22C 38/12; C22C 38/14; C22C 38/16; C22C 38/22; C22C 38/26; C22C 38/28; C22C 38/32; C22C 38/38; C22C 38/60
USPC ..... 428/639
See application file for complete search history.

(56) References Cited

U.S. PATENT DOCUMENTS

| | | | |
|---|---|---|---|
| 2018/0100212 | A1 | 4/2018 | Ono et al. |
| 2019/0017156 | A1 | 1/2019 | Kawamura et al. |
| 2023/0065607 | A1 | 3/2023 | Maruyama et al. |
| 2024/0175102 | A1 | 5/2024 | Yoshioka et al. |

FOREIGN PATENT DOCUMENTS

| | | | |
|---|---|---|---|
| JP | 2010248565 | A | 11/2010 |
| JP | 2011202195 | A | 10/2011 |
| JP | 5423072 | B2 | 2/2014 |
| JP | 2014196557 | A | 10/2014 |
| JP | 6017341 | B2 | 10/2016 |
| JP | 2019002078 | A | 1/2019 |
| KR | 1020120112813 | A | 10/2012 |
| KR | 1020180087347 | A | 8/2018 |
| WO | 2011118459 | A1 | 9/2011 |
| WO | 2016129214 | A1 | 8/2016 |
| WO | 2016152163 | A1 | 9/2016 |
| WO | 2017115748 | A1 | 7/2017 |
| WO | WO-2018123356 | A1 * | 7/2018 |
| WO | 2021149676 | A1 | 7/2021 |

OTHER PUBLICATIONS

Taji et al. JP 2010/248565 A Google Patents Machine Translation printed Mar. 13, 2025, Nov. 4, 2010, entire translation (Year: 2010).*

May 24, 2022, International Search Report issued in the International Patent Application No. PCT/JP2022/008469.

Sep. 13, 2022, Notification of Reasons for Refusal issued by the Japan Patent Office in the corresponding Japanese Patent Application No. 2022-541598 with English language Concise Statement of Relevance.

Apr. 22, 2025, Office Action issued by the Korean Intellectual Property Office in the corresponding Korean Patent Application No. 10-2023-7030449 with English language concise statement of relevance.

May 16, 2025, the Extended European Search Report issued by the European Patent Office in the corresponding European Patent Application No. 22779745.3.

May 15, 2025, Office Action issued by the China National Intellectual Property Administration in the corresponding Chinese Patent Application No. 202280024922.9 with English language search report.

Dec. 4, 2025, Office Action issued by the Ministry of Intellectual Property in the corresponding Korean Patent Application No. 10-2023-7030449 with English language concise statement of relevance.

* cited by examiner

STEEL SHEET, MEMBER, AND METHOD FOR PRODUCING STEEL SHEET, AND METHOD FOR PRODUCING MEMBER

TECHNICAL FIELD

This disclosure relates to high-strength steel sheets for cold press forming that are used in automobiles, home appliances, and other products through cold press forming, to members using the steel sheets, and to methods for producing them.

BACKGROUND

In recent years, the application of high-strength steel sheets with tensile strength (TS) of 1310 MPa or more to automotive body parts has been increasing due to the growing need for weight reduction of automotive body. In addition, from the viewpoint of further weight reduction, consideration is beginning to be given to increasing the strength to 1.8 GPa grade or higher. In the past, increased strength by hot pressing is being vigorously investigated. Recently, however, the application of cold pressing to high tensile strength steel is being reexamined from the viewpoint of cost and productivity.

Since martensitic microstructure tends to provide higher strength than relatively soft microstructures such as ferrite and bainite, it is effective to use mainly martensitic microstructure in the microstructural design of high-strength steel sheets. However, martensite-dominant steels have lower ductility than multi-phase steels, which contain relatively soft microstructures such as ferrite and bainite. For this reason, martensite-dominant steels have been applied only to those parts with relatively simple shapes, such as door beams and bumpers, which are formed generally by bending.

On the other hand, multi-phase steels have inferior delayed fracture resistance compared to martensite-dominant steels. In other words, to achieve the same strength in multi-phase steels as in martensite-dominant steels, it is necessary for multi-phase steels to contain a harder phase with a harder microstructure, which, however, acts as a starting point for delayed fracture due to the high stress concentration. Therefore, it has been difficult to simultaneously achieve high delayed fracture resistance and high formability in high-strength steel sheets.

If the ductility of martensitic microstructure itself, which has high delayed fracture resistance, can be improved, it may be possible to achieve both high delayed fracture resistance and high formability without having a multi-phase structure. One method to improve the ductility of martensitic microstructure is to increase the tempering temperature. However, this method is less effective in improving ductility and significantly degrades bending properties due to the formation of coarse carbides.

JP 6017341 B (PTL 1) describes a technology for a high-strength cold-rolled steel sheet having good bendability with a yield stress of 1180 MPa or more and a tensile strength of 1470 MPa or more, in which martensite is contained in an area ratio of 95% or more, while retained austenite and ferrite are less than 5% (inclusive of 0%) in total area ratio, and furthermore, the average size of carbide is 60 nm or less in equivalent diameter and the number density of carbide with an equivalent diameter of 25 nm or more is 0 per 1 $mm^2$.

JP 2019-2078 A (PTL 2) describes a technology for an ultra-high-strength steel sheet having a high yield ratio and high formability, the steel sheet having a microstructure containing 90% or more of martensite and 0.5% or more of retained austenite, in which regions where a local Mn concentration is 1.2 times or more than a Mn content of the entire steel sheet exist in an area ratio of 1% or more, the steel sheet having a tensile strength of 1470 MPa or more, a yield ratio of 0.75 or more, and a total elongation of 10% or more.

CITATION LIST

Patent Literature

PTL 1: JP 6017341 B
PTL 2: JP 2019-2078 A

SUMMARY

Technical Problem

In recent years, it has become possible to process even steel sheets with poor ductility into complex part shapes by utilizing press working technology. One of these methods is preforming technology, which suppresses the occurrence of cracking in a steel sheet by distributing strain over the entire steel sheet by preforming a portion of the steel sheet before forming it into the final shape, rather than forming it into the final shape in a single press working. In such a process, the introduction of strain is complicated. For example, deformation may occur in such a way that after uniaxial tension, strain may be applied in the biaxial direction in the next step, or in other words, the direction of strain applied in the first and second steps may be orthogonal. Press formability in such a process does not necessarily correlate with the property values evaluated in a uniaxial tensile test, which is a common formability evaluation test.

The technology described in PTL 1 may be sufficient in terms of ductility against bending deformation, which is frequently used in the forming of parts, since it provides high bendability. However, this technology is considered to be insufficient for martensite-dominant steels in terms of ductility when machined into parts with more complex shapes.

In the technology described in PTL 2, although certain elongation properties can be obtained by inclusion of retained austenite, the retained austenite transforms to hard martensite in response to working in a certain direction. Since hard martensite tends to act as a starting point for concentrated deformation, it may not exhibit sufficient formability in more complex, multi-step press working.

As described above, it is difficult to achieve excellent press formability in martensite-based high-strength steel sheets using conventional technology. Such excellent press formability is also required for members obtained by subjecting the steel sheets to forming or welding.

It would thus be helpful to provide a steel sheet with tensile strength of 1310 MPa or more that can achieve excellent press formability in a steel having a martensite-dominant microstructure with excellent delayed fracture resistance properties, a member using the steel sheet, a method for producing the steel sheet, and the method for producing the member.

Solution to Problem

In order to solve the above issues, the present inventors have studied diligently and obtained the following findings i) to v). The basic idea is to limit the content of soft microstructures such as retained austenite and ferrite, in which deformation tends to occur intensively in the more complicated and multi-step press working, and to improve the strain dispersion of the dominant martensitic microstructure itself.

i) Martensite-dominant steels can have complex internal stress fields due to thermal shrinkage and transformation expansion during the building up of a martensitic microstructure.

ii) In the presence of such internal stress fields, when deformation occurs during working, a particular region will preferentially begin to deform, and as the deformation progresses, multiple regions will begin to deform in stages, resulting in strain being distributed throughout the steel sheet.

iii) Although it is difficult to directly observe such internal stress fields, the crystal orientation of a block, which is a substructure of martensite, is affected by the stress field during the formation of martensite, and the size of a stress field can be indirectly estimated from the crystal orientation information of the block.

iv) The tendency of crystal orientation in a block can be varied by controlling the cooling rate in a certain temperature range during the formation of the martensitic microstructure.

v) The crystal orientation of a block is greatly affected by the Ms point, the temperature at which martensite begins to form, and the more uniformly distributed the Mn concentration that changes the Ms point, the better the strain dispersion. This distribution of Mn concentration is achieved by creating proper hot-rolled microstructures.

The present disclosure was completed based on these findings, and primary features thereof are as described below.

1. A steel sheet comprising: a chemical composition containing (consisting of), by mass %, C: 0.12% or more and 0.40% or less, Si: 1.5% or less, Mn: more than 1.7% and 3.5% or less, P: 0.05% or less, S: 0.010% or less, sol.Al: 1.00% or less, N: 0.010% or less, Ti: 0.002% or more and 0.080% or less, and B: 0.0002% or more and 0.0050% or less, with the balance being Fe and inevitable impurities; a metallic structure in which an area ratio of martensite to an entire microstructure is 85% or more, and a ratio $L_S/L_B$ satisfies the following formula (1), where $L_S$ denotes a length of a sub-block boundary and $L_B$ denotes a length of a block boundary:

$$0.06/[C\ \%]^{0.8} \leq L_S/L_B \leq 0.13/[C\ \%]^{0.8} \quad (1),$$

where [C %] represents a C content in mass %; and a tensile strength of 1310 MPa or more.

(2) The steel sheet according to aspect (1), wherein the chemical composition further contains, by mass %, at least one selected from the group consisting of Cu: 0.01% or more and 1.00% or less, Ni: 0.01% or more and 1.00% or less, Mo: 0.005% or more and 0.350% or less, Cr: 0.005% or more and 0.350% or less, Zr: 0.005% or more and 0.350% or less, Ca: 0.0002% or more and 0.0050% or less, Nb: 0.002% or more and 0.060% or less, V: 0.005% or more and 0.500% or less, W: 0.005% or more and 0.200% or less, Sb: 0.001% or more and 0.100% or less, Sn: 0.001% or more and 0.100% or less, Mg: 0.0002% or more and 0.0100% or less, and REM: 0.0002% or more and 0.0100% or less.

(3) The steel sheet according to aspect (1) or (2), wherein the Mn has a standard deviation of concentration of 0.35% or less.

(4) The steel sheet according to any one of aspects (1)-(3), comprising a galvanized layer on a surface thereof.

(5) A member obtainable by subjecting the steel sheet as recited in any one of aspects (1)-(4) to at least one of forming or welding.

(6) A method for producing a steel sheet, comprising: subjecting a steel material having the chemical composition as recited in aspect (1) or (2) to hot rolling to obtain a hot-rolled steel sheet, and then subjecting the hot-rolled steel sheet to cold rolling to obtain a cold-rolled steel sheet; and subjecting the cold-rolled steel sheet to soaking treatment at or above $Ac_3$ point for 240 seconds or more, followed by primary cooling in which the cold-rolled steel sheet is cooled at an average cooling rate of 10° C./s or higher in a temperature range from a cooling start temperature of 680° C. or higher to Ms point, followed by secondary cooling in which the cold-rolled steel sheet is cooled at an average cooling rate of 100° C./s or higher in a temperature range from the Ms point to a temperature of (the Ms point—50° C.), followed by tertiary cooling in which the cold-rolled steel sheet is cooled to a temperature of 50° C. or lower at an average cooling rage of 70° C./s or higher.

(7) The method for producing a steel sheet according to aspect (6), wherein after the tertiary cooling, reheating is performed in which the cold-rolled steel sheet is held in a temperature range from 150° C. to 300° C. for 20 seconds to 1500 seconds.

(8) The method for producing a steel sheet according to aspect (6) or (7), wherein the secondary cooling uses water as a refrigerant and has a water flux density of 0.5 $m^3/m^2/min$ or more and 10.0 $m^3/m^2/min$ or less.

(9) The method for producing a steel sheet according to any one of aspects (6)-(8), wherein the hot rolling includes rolling the steel material at a rolling finish temperature of 840° C. or higher, then cooling the steel material to a temperature of 640° C. or lower within 3 seconds, then holding the steel material in a temperature range from 600° C. to 500° C. for 5 seconds or more, and then coiling the steel material at a temperature of 550° C. or lower.

(10) The method for producing a steel sheet according to any one of aspects (7)-(9), wherein after the reheating, coating or plating treatment is performed.

(11) A method for producing a member, comprising subjecting a steel sheet produced by the method as recited in any one of aspects (6)-(10) to at least one of forming or welding.

Advantageous Effect

According to the present disclosure, it is possible to provide a steel sheet with a tensile strength of 1310 MPa or more that simultaneously achieves excellent delayed fracture resistance and press formability. The improvements in these properties will promote the widespread use of high-strength steel sheets in cold press forming applications for parts with more complex shapes, contributing to increased part strength and weight reduction.

DETAILED DESCRIPTION

Figure 1:
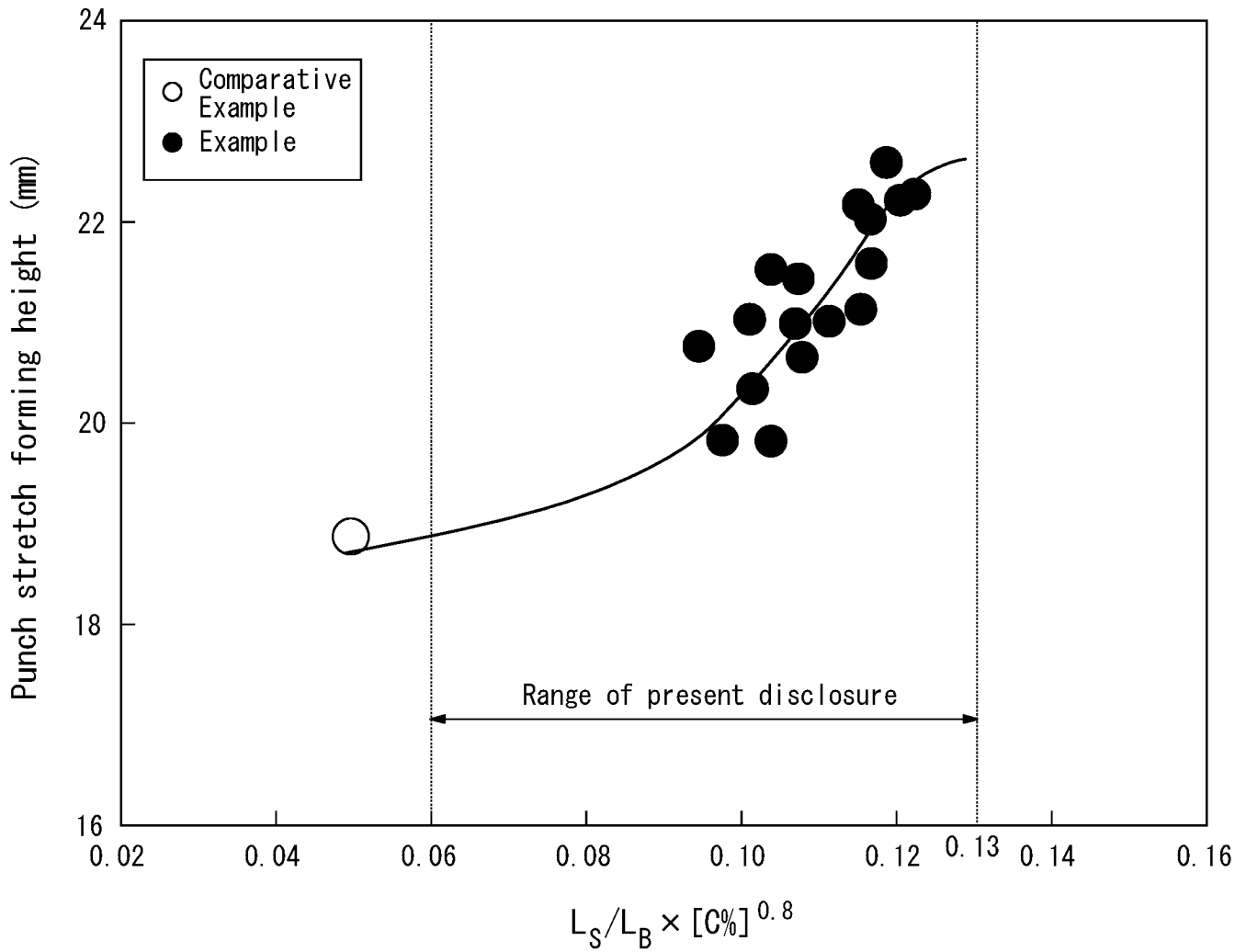
FIG. 1 is a graph illustrating the relationship between the ratio $L_S/L_B$ and the punch stretch forming height.

The following describes embodiments of the present disclosure. However, the present disclosure is not limited to the following examples. First, the content of each component in the chemical composition of the steel sheet will be explained. The "%" used below to indicate the content of a component means "mass %" unless otherwise specified.

C: 0.12% or More and 0.40% or Less

C is contained to improve quench hardenability and to obtain a predetermined area ratio of martensite. C is also contained from the viewpoint of increasing the strength of martensite and ensuring TS≥1310 MPa. When the C content is less than 0.12%, it is difficult to obtain a predetermined strength in a stable manner. Furthermore, from the viewpoint of ensuring TS≥1470 MPa, the C content is desirably 0.18% or more. If the C content exceeds 0.40%, the strength becomes too high, toughness decreases, and press formability deteriorates. Therefore, the C content is 0.12% to 0.40%. The C content is preferably 0.36% or less.

Si: 1.5% or Less

Si is added as a strengthening element by solid solution strengthening. The lower limit of the Si content is not specified, yet from the viewpoint of obtaining this effect, the Si content is desirably 0.02% or more. The Si content is more desirably 0.1% or more. On the other hand, if the Si content exceeds 1.5%, toughness decreases and press formability deteriorates. In addition, a Si content exceeding 1.5% causes a significant increase in rolling load in hot rolling. Therefore, the Si content is 1.5% or less. The Si content is preferably 1.2% or less.

Mn: More than 1.7% and 3.5% or Less

Mn is contained to improve the quench hardenability of the steel and to keep the area ratio of martensite within a predetermined range. Mn also solidly dissolves in martensite to increase the strength of martensite. Mn is contained in excess of 1.7% to ensure a predetermined area ratio of martensite in an industrially stable manner. On the other hand, the upper limit of the Mn content is 3.5% for the purpose of ensuring welding stability and from the viewpoint of avoiding deterioration of press formability due to the formation of coarse MnS. It is preferably 3.2% or less, and more preferably 3.0% or less.

P: 0.05% or Less

P is an element that strengthens steel, yet a high P content reduces toughness and degrades press formability and spot weldability. Therefore, the P content is 0.05% or less. From the above viewpoint, the P content is preferably 0.02% or less. The lower limit of the P content does not need to be limited, yet from a cost perspective, the P content is preferably 0.002% or more, as it would require significant cost to lower the P content below 0.002%.

S: 0.010% or Less

Since S degrades the press formability through the formation of coarse MnS, the S content should be 0.010% or less. From this perspective, the S content is preferably 0.005% or less. It is more preferably 0.002% or less. The lower limit of the S content does not need to be limited, yet from a cost perspective, the S content is preferably 0.0002% or more, as it would require significant cost to lower the S content below 0.0002%.

sol.Al: 1.00% or Less

Al is contained to provide sufficient deoxidation and to reduce inclusions in the steel. The lower limit of the sol.Al content is not specified, yet for stable deoxidation, the sol.Al content is desirably 0.003% or more, and more desirably 0.01% or more. On the other hand, if the sol.Al content exceeds 1.00%, a large amount of Al-based coarse inclusions are formed and press formability deteriorates. Therefore, the sol.Al content is 1.00% or less. The sol.Al content is preferably 0.80% or less.

N: 0.010% or Less

The addition amount of N should be limited because N forms coarse nitrides, which degrade press formability. Therefore, the N content should be 0.010% or less. The N content is preferably 0.006% or less. Although no particular lower limit is placed on the N content, an industrially feasible lower limit is about 0.0005% at present, and thus a substantial lower limit is 0.0005% or more.

Ti: 0.002% or More and 0.080% or Less

Ti is contained to stabilize the quench hardenability by ensuring solute B by causing TiN to form prior to the formation of BN. To obtain this effect, the Ti content should be 0.002% or more. The Ti content is preferably 0.005% or more. On the other hand, excessive Ti content causes the formation of large amounts of coarse inclusions such as TiN and TiC, which degrades press formability. Therefore, the Ti content should be 0.080% or less. The Ti content is preferably 0.060% or less, and more preferably 0.055% or less.

B: 0.0002% or More and 0.0050% or Less,

B is an element that improves the quench hardenability of the steel and has the effect of forming martensite in a predetermined area ratio even with a small Mn content. To obtain this effect of B, the B content is preferably 0.0002% or more, and more preferably 0.0005% or more. On the other hand, when the B content exceeds 0.0050%, the effect reaches a plateau. Therefore, the B content is 0.0002% or more and 0.0050% or less. The B content is preferably 0.0040% or less, and more preferably 0.0030% or less.

The steel sheet disclosed herein has a chemical composition that contains the above group of components (C, Si, Mn, P, S, sol.Al, N, Ti, and B) as the basic components, with the balance containing Fe (iron) and inevitable impurities. In particular, it is preferred that the steel sheet in one embodiment of the present disclosure have a chemical composition that contains the above components as the basic components, with the balance consisting of Fe and inevitable impurities. The inevitable impurities include, but are not limited to, H, He, Li, Be, O (oxygen), F, Ne, Na, Cl, Ar, K, Co, Zn, Ga, Ge, As, Se, Br, Kr, Rb, Sr, Tc, Ru, Rh, Pd, Ag, Cd, In, Te, I, Xe, Cs, Ba, La, Hf, Ta, Re, Os, Ir, Pt, Au, Hg, Tl, Pb, Bi, Po, At, Rn, Fr, Ra, Ac, Rf, Ha, Sg, Ns, Hs, and Mt. Furthermore, the chemical composition of the steel sheet may contain at least one selected from the following optional elements as needed, in addition to the above-described group of components.

Cu: 0.01% or More and 1.00% or Less

Cu improves corrosion resistance in automotive operating environments. Cu also has the effect of causing the surface of the steel sheet to be coated with corrosion products when added, suppressing hydrogen entry to the steel sheet. From this viewpoint, the Cu content is preferably 0.01% or more, and from the viewpoint of improving delayed fracture resistance, it is more preferably 0.05% or more. However, since an excessively high Cu content can cause surface defects, the Cu content is desirably 1.00% or less. The Cu content is more preferably 0.5% or less, and even more preferably 0.3% or less.

Ni: 0.01% or More and 1.00% or Less

Like Cu, Ni is an element that improves corrosion resistance. Ni also acts to reduce surface defects that tend to occur when Cu is contained. Therefore, the Ni content is desirably 0.01% or more from the above viewpoint. However, too high Ni content in steel not only results in uneven scale generation in a heating furnace to cause surface defects in a resulting steel sheet but also significantly increases production cost. Therefore, the Ni content is desirably 1.00% or less. It is more preferably 0.5% or less, and even more preferably 0.3% or less.

Mo: 0.005% or More and 0.350% or Less

Mo can be added for the purpose of obtaining the effect of improving the quench hardenability of the steel and ensuring a predetermined strength in a stable manner. To obtain this effect, the Mo content is desirably 0.005% or more. However, a Mo content above 0.350% degrades the chemical convertibility. Therefore, the Mo content is desirably 0.005% or more and 0.350% or less. The Mo content is more preferably 0.20% or less.

Cr: 0.005% or More and 0.350% or Less

Cr can be added for the purpose of obtaining the effect of improving the quench hardenability of the steel. To obtain this effect, the Cr content is preferably 0.005% or more. However, a Cr content above 0.350% degrades the chemical convertibility. Therefore, the Cr content is desirably 0.005% to 0.350%. Since the chemical convertibility tends to start deteriorating at a Cr content greater than 0.20%, the Cr content is more preferably 0.200% or less from the viewpoint of preventing such deterioration.

Zr: 0.005% or More and 0.350% or Less

Zr contributes to higher strength through the refinement of the prior γ grain size and the ensuing refinement of the internal structure of martensite. From this perspective, the Zr content is desirably 0.005% or more. However, adding a large amount of Zr increases coarse Zr-based precipitates and degrades press formability. Therefore, the Zr content is desirably 0.350% or less. It is more preferably 0.20% or less, and even more preferably 0.05% or less.

Ca: 0.0002% or More and 0.0050% or Less

Ca fixes S as CaS and improves press formability. To obtain this effect, the Ca content is desirably 0.0002% or more. However, adding a large amount of Ca degrades the surface quality. Therefore, the Ca content is desirably 0.0050% or less. It is more preferably 0.0030% or less.

Nb: 0.002% or More and 0.060% or Less

Nb contributes to higher strength through the refinement of the prior γ grain size and the ensuing refinement of the internal structure of martensite. From this perspective, the Nb content is desirably 0.002% or more. However, adding a large amount of Nb increases coarse Nb-based precipitates and degrades the press formability. Therefore, the Nb content is desirably 0.060% or less. It is more preferably 0.030% or less, and even more preferably 0.015% or less.

V: 0.005% or More and 0.500% or Less

V can be added for the purpose of obtaining the effects of improving the quench hardenability of the steel and increasing strength through refinement of martensite. To obtain these effects, the V content is desirably 0.005% or more. However, a V content above 0.500% significantly degrades castability. Therefore, the V content is desirably 0.005% or more. The V content is desirably 0.500% or less. It is more preferably 0.200% or less, and even more preferably 0.100% or less.

W: 0.005% or More and 0.200% or Less

W contributes to higher strength through the formation of fine W-based carbides and W-based carbonitrides. From this perspective, the W content is desirably 0.005% or more. However, adding a large amount of W increases coarse precipitates remaining without reaching a solid solution state during slab heating in the hot rolling process and degrades press formability. Therefore, the W content is desirably 0.200% or less. It is more preferably 0.100% or less, and even more preferably 0.050% or less.

Sb: 0.001% or More and 0.100% or Less

Sb inhibits oxidation and nitriding of the surface layer, thereby suppressing the reduction in the content of C and B. Suppression of the reduction in the content of C and B inhibits the formation of ferrite in the surface layer and contributes to higher strength. From this perspective, the Sb content is desirably 0.001% or more. However, a Sb content above 0.100% degrades castability and causes Sb segregation in prior γ grain boundaries, resulting in deterioration of toughness and press formability. Therefore, the Sb content is desirably 0.100% or less. It is more preferably 0.050% or less, and even more preferably 0.015% or less.

Sn: 0.001% or More and 0.100% or Less

Sn inhibits oxidation and nitriding of the surface layer, thereby suppressing the reduction in the content of C and B in the surface layer. Suppression of the reduction in the content of C and B inhibits the formation of ferrite in the surface layer, which contributes to higher strength and improved delayed fracture resistance. From this perspective, the Sn content is desirably 0.001% or more. However, a Sn content above 0.100% degrades castability and causes Sn segregation in prior γ grain boundaries, resulting in deterioration of toughness and press formability. Therefore, the Sn content is desirably 0.100% or less. It is more preferably 0.050% or less, and even more preferably 0.015% or less.

Mg: 0.0002% or More and 0.0100% or Less

Mg fixes O as MgO and improves press formability. To obtain this effect, the Mg content is desirably 0.0002% or more. However, adding a large amount of Mg degrades the surface quality and press formability. Therefore, the Mg content is desirably 0.0100% or less. It is more preferably 0.0050% or less, and even more preferably 0.0030% or less.

REM: 0.0002% or More and 0.0100% or Less

REM improves press formability by refining inclusions and reducing starting points for fracture. To obtain this effect, the REM content is preferably 0.0002% or more. However, adding a large amount of REM, on the contrary, coarsens inclusions and degrades the press formability. Therefore, the REM content is desirably 0.0100% or less. It is more preferably 0.0050% or less, and even more preferably 0.0030% or less.

For any of the above optional elements, if the content is less than the lower limit mentioned above, the optional element is considered as an inevitable impurity.

Next, the metallic structure and tensile strength of the steel sheet disclosed herein will be described.

(Requirement 1 for Metallic Structure)

Area Ratio of Martensite to the Entire Microstructure: 85% or More

In order for the steel sheet disclosed herein to obtain a predetermined strength, the area ratio of martensite to the entire microstructure should be 85% or more. The area ratio of martensite may be 100%. The residual microstructures other than martensite include bainite, ferrite, and retained austenite. However, if the total area ratio of these microstructures exceeds 15%, i.e., the area ratio of martensite is less than 85%, the residual microstructures, i.e., bainite, ferrite, and retained austenite increase, making it difficult to obtain a predetermined strength.

One method to ensure a predetermined strength even when the area ratio of martensite is less than 85% is, for example, to lower the tempering temperature. However, if the tempering temperature is excessively low, toughness decreases and press formability deteriorates. Increasing the amount of C can also increase strength, but may degrade weldability, which is undesirable. Therefore, to ensure a predetermined strength together with excellent press formability, the area ratio of martensite should be 85% or more. In this case, martensite includes tempered martensite, martensite that has been self-tempered during continuous cooling, and martensite that has not been tempered. The remainder includes bainite, ferrite, retained austenite (γ), and inclusions such as carbides, sulfides, nitrides, and oxides. The area ratio of martensite may be 100% without the remainder.

(Requirement 2 for Metallic Structure)

In the steel sheet disclosed herein, a ratio $L_S/L_B$ satisfies the following formula (1), where $L_S$ denotes a length of a sub-block boundary and $L_B$ denotes a length of a block boundary:

$$0.06/[C\ \%]^{0.8} \leq L_S/L_B \leq 0.13/[C\ \%]^{0.8} \quad (1),$$

where [C %] represents a C content.

The substructure of martensite has a hierarchical structure and is referred to as packet, block, and lath in order of size. A packet is a microstructure that breaks up a prior γ grain into several regions, and represents a group of laths with the same crystalline habit plane. A block is a microstructure that breaks up a packet, and represents a group of laths with approximately the same crystal orientation. In general, block boundaries are formed by large-angle grain boundaries with crystal orientation differences of 15 degrees or more. However, relatively low-angle orientation differences may appear within blocks, and are called sub-block boundaries. The present inventors investigated the correlation between the amount of sub-block boundaries and press forming testing on actual parts, and came to recognize the possibility that the more sub-block boundaries there are, the smaller the thickness reduction in the actual part and the higher the strain dispersion in the actual part, even in complex press working.

Although the mechanism is not clear, it is considered to be due to the internal stress field formed within martensite, which causes the yield strength of martensite to vary from grain to grain and deformation to proceed in various regions. In other words, if martensite transformation proceeds while forming many block boundaries, which are large-angle grain boundaries, the strain due to martensitic transformation is considered to be smaller, resulting in a smaller internal stress field at the time martensitic transformation is complete. On the other hand, sub-block boundaries are often observed in steels with relatively low C content, presumably because the deformation resistance of the surrounding austenite depends on the C content and indirectly affects the crystal orientation selection of blocks during the transformation expansion caused by martensite transformation.

From the above experimental results and estimations, the present inventors came to the conclusion that diffusion and concentration of C in the austenite region immediately after the start of formation of martensite may affect the crystal orientation selection of blocks.

The present inventors conducted further detailed experiments and found that when the ratio of the length of a sub-block boundary $L_S$ to the length of a block boundary $L_B$, denoted as $L_S/L_B$ (hereinafter simply referred to as "the ratio"), is used as an index of the amount of sub-block boundaries, the ratio $L_S/L_B$ depends on the C content, that controlling the ratio within a predetermined range according to the C content can improve formability, and that such ratio is achieved by controlling the cooling conditions appropriately. First, for steel sheets with various C contents ranging from 0.10% to 0.46%, an L-section was polished and then finish polished with colloidal silica, and a 200 μm×200 μm region was analyzed by electron backscattered diffraction (EBSD) at a ¼ thickness position from the steel sheet surface. The obtained crystal orientation data was analyzed using analysis software (OIM Analysis Ver. 7) available from TSL Solutions, Inc. The step size was set to 0.2 μm. Since ferrite, bainite, and martensite have the same body-centered cubic (BCC) structure, it is difficult to distinguish between them on the crystal orientation map (crystal orientation data) by EBSD, and since the microstructures according to the present disclosure are mostly martensite-dominant, the orientation relationship in crystal grain boundaries was quantified for those regions with BCC structure including these microstructures. Block boundaries were defined as locations where the crystal orientation difference between adjacent steps was 15 degrees or more, and sub-block boundaries were defined as locations where the crystal orientation difference between adjacent steps was 3 degrees or more and less than 15 degrees. The length of each boundary was automatically measured when the boundary was drawn on the analysis software described above, and the length of the block boundary $L_B$ and the length of the sub-block boundary $L_S$ were thus measured using the analysis software. The formability of each steel sheet was evaluated according to the methods described in the EXAMPLES section below.

The results of this measurement (ratio $L_S/L_B$) and evaluation (punch stretch forming height) are illustrated in FIG. 1. It can be seen from the figure that excellent formability with punch stretch forming heights of 19.5 mm or more can be obtained in the region where the ratio $L_S/L_B$ is $0.06/[C\ \%]^{0.8}$ or more in relation to the C content. The higher the value of this ratio $L_S/L_B$, the more effective it is. However, this effect was also found to saturate within a certain range. In other words, if the ratio $L_S/L_B$ increases beyond $0.13/[C\ \%]^{0.8}$, the effect reaches a plateau. As such, the practical upper limit is $0.13/[C\ \%]^{0.8}$.

The ratio $L_S/L_B$ can be set in the range specified by the formula (1) mainly by appropriately controlling cooling conditions. The details of the cooling conditions will be described below. Conventionally, the cooling rate for building up a martensitic microstructure has been mainly focused on suppressing the formation of ferrite and bainite on the high temperature side above Ms point, and an excessive increase in cooling rate has not been actively considered because of the increased equipment cost. From this perspective, the cooling rate for building up a martensitic microstructure has been often controlled by the average cooling rate from a high temperature range of about 700° C., where no ferrite is formed, to the temperature at which martensitic transformation is complete. In practice, however, the cooling rate decreases rapidly as the steel sheet temperature decreases.

For example, even in the technology described in PTL 1, only the average cooling rate is specified, and in all examples, it is described as exceeding 1000° C./s. There is no attempt to precisely understand and control the cooling rate in each temperature range in the cooling process. The reason for limiting the cooling rate is only from the viewpoint of suppressing the formation of ferrite and bainite and the precipitation of coarse carbides after the formation of martensite, not from the fact that the crystal orientation selection of blocks, which is the substructure, can be controlled.

The present inventors have newly discovered that in order to control the crystal orientation selection of blocks, it is necessary to control the cooling rate in a specific temperature range from Ms point and below, and that to achieve this cooling rate control, performing the conventional cooling methods alone is insufficient, and the cooling conditions described below are necessary.

(Suitable Requirements for Metallic Structure)

Standard deviation of Mn concentration: 0.35% or less

Mn is segregated during casting and tends to be distributed in bands in the thickness direction through the rolling process. Since Mn has a significant effect on Ms point, if the Mn concentration has a band-like distribution, the distribution of internal stress due to martensitic transformation will also be a band-like form and anisotropic. From this perspective, the distribution of Mn concentration is desirably uniform, specifically, the standard deviation of Mn concentration is desirably 0.35% or less. Mn is known to concentrate in cementite, and the formation of cementite is affected by microstructure formation during hot rolling, as described below.

The standard deviation of Mn concentration was determined as follows. After mirror polishing an L-section of each steel sheet, a 300 μm×300 μm region, ranging from a ⅜ thickness position to a ⅝ thickness position of the steel sheet, was analyzed using an electron probe microanalyzer (EPMA). The accelerating voltage was 15 kV, the beam diameter was 1 μm, and the beam current was $2.5\times10^{-6}$ A. The standard deviation was calculated from the obtained 300×300 quantitative values of Mn.

(Tensile Strength (TS): 1310 MPa or More)

Martensitic microstructure is often used in steel sheets with a tensile strength of 1310 MPa or more. One of the characteristics of the present disclosure is that good press formability is obtained even at 1310 MPa or more. Therefore, the tensile strength of the steel sheet according to the present disclosure is 1310 MPa or more.

The steel sheet according to the present disclosure may also have a coating or plating layer on a surface thereof. The type of coating or plating layer is not limited and can be either a coated or plated layer of zinc (Zn), also called a galvanized layer, or a coated or plated layer of metals other than Zn. The coating or plating layer may also contain components other than the main component such as Zn. The galvanized layer is, for example, an electrogalvanized layer.

Next, the method for producing a steel sheet according to the present disclosure will be described. In this method, a steel material such as a slab having the chemical composition described above is subjected to hot rolling to obtain a hot-rolled steel sheet, and the hot-rolled steel sheet is then subjected to cold rolling to obtain a cold-rolled steel sheet. Next, the cold-rolled steel sheet is subjected to soaking treatment at or above $Ac_3$ point for 240 seconds or more, followed by primary cooling in which the cold-rolled steel sheet is cooled at an average cooling rate of 10° C./s or higher in a temperature range from a cooling start temperature of 680° C. or higher to Ms point. The process is followed by secondary cooling in which the cold-rolled steel sheet is cooled at an average cooling rate of 100° C./s or higher in a temperature range from the Ms point to a temperature of (the Ms point—50° C.). The process is followed by tertiary cooling in which the cold-rolled steel sheet is cooled to a temperature of 50° C. or lower at an average cooling rage of 70° C./s or higher. Using this method, the steel sheet according to the present disclosure can be produced. In the present disclosure, the preparation, hot rolling, and cold rolling of the steel material can follow the conventional methods. However, it is important that heat treatment (including soaking treatment, primary cooling, secondary cooling, and tertiary cooling) be performed on the steel sheet under the predetermined conditions after cold rolling. The hot rolling is preferably performed under the following conditions as needed.

(Hot Rolling)

In the hot rolling, rolling, cooling, holding, and coiling processes are preferably performed in this order. The rolling finish temperature is preferably 840° C. or higher from the viewpoint of preventing ferrite from forming and increasing thickness variation. After the rolling (finish rolling), the steel sheet is preferably cooled down to 640° C. or lower within 3 seconds and held in the temperature range from 600° C. to 500° C. for 5 seconds or more. This is because coarse ferrite is formed if the steel sheet is held at high temperatures, and C is enriched in the untransformed regions and cementite tends to form locally. By holding at the predetermined temperature, bainite is more easily obtained and excessive C enrichment is less likely to occur. The coiling process after the holding is preferably performed at a temperature of 550° C. or lower. Coiling at a temperature of 550° C. or lower can suppress the formation of pearlite encapsulating coarse cementite. The upper limit of the rolling finish temperature need not be particularly limited, yet from the viewpoint of preventing the formation of coarse grains in some parts and increasing thickness variation, the upper limit is preferably 950° C.

(Heat Treatment)

<Soaking Treatment: At or Above $Ac_3$ Point for 240 Seconds or More>

In the present disclosure, in order to obtain predetermined martensite, the steel sheet after subjection to cold rolling (i.e., cold-rolled steel sheet) should be subjected to soaking treatment at or above $Ac_3$ point for 240 seconds or more. If the soaking temperature (annealing temperature) is lower than the $Ac_3$ point or the soaking time is less than 240 seconds, austenite is not sufficiently formed during annealing and the predetermined area ratio of martensite cannot be ensured in the final product, making it impossible to obtain a tensile strength of 1310 MPa or more. Although the upper limits of the annealing temperature and soaking time are not limited, increasing the annealing temperature or soaking time above a certain value may coarsen the austenite grain size and deteriorate the toughness. Therefore, the annealing temperature is preferably 1150° C. or lower and the soaking time is preferably 900 seconds or less.

<Primary Cooling>

To reduce bainite, ferrite, and retained austenite (γ) and adjust the area ratio of martensite to 85% or more, it is necessary to perform, as the primary cooling after the soaking treatment, cooling at an average cooling rate of 10° C./s or higher in a temperature range from a high temperature at or above 680° C. (i.e., cooling start temperature) to the Ms point. First, if the cooling start temperature is lower than 680° C., more ferrite is formed. Furthermore, if the average cooling rate is lower than 10° C./s, bainite is formed. The upper limit of the average cooling rate need not be particularly limited, yet from the perspective of avoiding increased production costs, the upper limit is preferably 1500° C./s.

<Secondary Cooling>

After the primary cooling, it is necessary to perform, as the secondary cooling, cooling at an average cooling rate of 100° C./s or higher in a temperature range from the Ms point to a temperature of (the Ms point—50° C.). This is to control C diffusion and enrichment during the progression of martensitic transformation and to obtain more sub-block boundaries. The cooling rate in a low temperature range tends to be slow due to the heat generated by martensitic transformation in addition to the smaller temperature difference between the steel sheet temperature and the coolant. Conventionally, however, the importance of controlling the cooling rate in such a temperature range has not been known, and there have been few attempts to measure, let alone control, the cooling rate. As such, the average cooling rate from the quenching start temperature has been conventionally used to control the microstructural design.

The present inventors conducted cooling experiments using a sample of 2 mm thick steel sheet with a thermocouple embedded in the mid-thickness part, using water as the refrigerant, to investigate the relationship between cooling conditions and cooling rate in detail. As a result, it was found that water cooling with a water flux density of 0.5 $m^3/m^2/min$ or more is effective in achieving the predetermined cooling rate. In this case, the refrigerant is assumed to be inexpensive water, yet it is not limited to water in terms of obtaining further cooling capacity.

To achieve a predetermined water flux density, the shape, arrangement, flow rate, and other conditions of nozzles injecting the refrigerant may be changed as needed. The upper limit of the water flux density is not limited, yet from the viewpoint of avoiding excessive production cost increase, the water flux density in the case of cooling water was set to 10 $m^3/m^2/min$ or less. The examples described below were conducted on an actual production line, where the cooling rate in a gas atmosphere could be measured with a steel sheet thermometer, but the steel sheet temperature during water cooling could not be measured. Therefore, the cooling rate during water cooling in the actual production line was determined by heat transfer calculation based on the thickness of the steel material, the steel sheet temperature just before water cooling, the sheet passing speed, the water flux density, and so on. The validity of the heat transfer calculations was examined by comparing the steel sheet properties in the laboratory cooling experiments described above with those of the materials produced in the actual production line, and the validity was confirmed.

<Tertiary Cooling>

Following the above secondary cooling, it is necessary to perform, as the tertiary cooling, cooling to a temperature of 50° C. or lower at an average cooling rate of 70° C./s or higher. This prevents softening due to self-tempering of martensite. If the average cooling rate is lower than 70° C./s, tempering of martensite progresses and it becomes difficult to obtain the predetermined strength.

The $Ac_3$ and Ms points can be determined from the following equations:

$$Ac_3 \text{ point}(^\circ \text{ C.})=910-203\times[C\ \%]^{0.5}+44.7\times[Si\ \%]+31.5\times[Mo\ \%]-30\times[Mn\ \%]-11\times[Cr\ \%]+700\times[P\ \%]+400\times[A1\%]+400\times[Ti\ \%],$$

and $$Ms \text{ point } (^\circ \text{ C.})=561-474\times[C\ \%]-33\times[Mn\ \%]-17\times[Cr\ \%]-17\times[Ni\ \%]-21\times[Mo\ \%].$$

<Reheating (Annealing)>

The toughness of martensite is known to be improved by tempering, and proper temperature control is preferable to ensure excellent press formability. In other words, after quenching down to 50° C. or lower by the tertiary cooling, reheating is preferably performed in a temperature range from 150° C. to 300° C. for 20 seconds to 1500 seconds. If the holding temperature is lower than 150° C. or the holding time is less than 20 seconds, tempering of martensite is insufficient, which may result in deterioration of press formability. On the other hand, if the holding temperature is higher than 300° C., coarse cementite forms, which may end up degrading the press formability. In addition, if the holding time is more than 1500 seconds, not only does this saturate the effect of tempering, but it also increases production costs, and even worse, the press formability may deteriorate due to coarsening of carbides.

The resulting steel sheet may be subjected to skin pass rolling or leveling from the viewpoint of stabilizing the shape accuracy of press forming, such as adjustment of roughness on the sheet surface and flattening of the sheet shape.

The resulting steel sheet may also be subjected to coating or plating treatment. Through the coating or plating treatment, the steel sheet may be provided with a coated or plated layer such as a galvanized layer on a surface thereof. The type of coating or plating treatment is not limited and can be either hot dip coating or electroplating. The coating or plating treatment may also include an alloying process after hot dip coating. In the case of performing the coating or plating treatment together with the skin pass rolling, the skin pass rolling is performed after the coating or plating treatment.

The following is a description of the member according to the present disclosure and its production method.

The component according to the present disclosure is obtainable by subjecting the steel sheet disclosed herein to at least one of forming or welding. The method for producing the member according to the present disclosure comprises subjecting the steel sheet produced by the method disclosed herein to at least one of forming or welding.

The steel sheet according to the present disclosure has a tensile strength of 1310 MPa or more and excellent press formability. Therefore, the member that is obtained from the steel sheet according to the present disclosure also has high strength and superior press formability compared to conventional high-strength members. In addition, the member disclosed herein can be used to achieve weight reduction. Therefore, the member disclosed herein can be suitably used, for example, in automotive body parts.

As for the forming, there is no particular limitation, and general processing methods such as press working can be employed. As for the welding, there is no particular limitation, and general welding such as spot welding, arc welding, or other welding can be employed.

EXAMPLES

Example 1

Steels with the chemical compositions listed in Table 1 were prepared by smelting and cast into slabs. The slabs were subjected to hot rolling under the conditions listed in Table 2. The resulting hot-rolled steel sheets were subjected to pickling and subsequent cold rolling to obtain cold-rolled steel sheets. The cold-rolled steel sheets thus obtained were subjected to thermal treatment under the conditions listed in Table 2. Then, 0.1% temper rolling was performed to obtain steel sheets. In order to confirm the effects of differences in microstructures formed during the hot rolling on the Mn concentration uniformity and the press formability, another two examples of steel sheets were produced under approximately the same conditions, except that the hot rolling conditions were changed as presented in Table 3.

TABLE 1

| Slab | Chemical composition [mass %] | | | | | | | | | | Ac3 point | Ms point | |
|---|---|---|---|---|---|---|---|---|---|---|---|---|---|
| No. | C | Si | Mn | P | S | sol. Al | N | Ti | B | Others | [° C.] | [° C.] | Remarks |
| A | 0.13 | 0.1 | 3.0 | 0.02 | 0.002 | 0.02 | 0.003 | 0.029 | 0.0020 | | 784 | 398 | Conforming steel |
| B | 0.38 | 1.2 | 2.5 | 0.01 | 0.002 | 0.02 | 0.005 | 0.019 | 0.0025 | | 786 | 298 | Conforming steel |
| C | 0.20 | 1.4 | 1.8 | 0.02 | 0.002 | 0.02 | 0.003 | 0.043 | 0.0018 | | 867 | 407 | Conforming steel |
| D | 0.18 | 0.3 | 1.8 | 0.02 | 0.001 | 0.03 | 0.004 | 0.017 | 0.0019 | | 816 | 416 | Conforming steel |
| E | 0.25 | 0.9 | 3.5 | 0.01 | 0.002 | 0.02 | 0.004 | 0.003 | 0.0037 | | 760 | 327 | Conforming steel |
| F | 0.18 | 0.6 | 2.3 | 0.04 | 0.002 | 0.04 | 0.004 | 0.033 | 0.0029 | | 839 | 400 | Conforming steel |
| G | 0.22 | 1.3 | 1.9 | 0.01 | 0.004 | 0.03 | 0.004 | 0.019 | 0.0027 | | 842 | 394 | Conforming steel |
| H | 0.37 | 0.3 | 3.4 | 0.01 | 0.001 | 0.80 | 0.004 | 0.011 | 0.0023 | | 1029 | 273 | Conforming steel |
| I | 0.16 | 0.6 | 3.1 | 0.02 | 0.001 | 0.04 | 0.007 | 0.017 | 0.0028 | | 799 | 383 | Conforming steel |
| J | 0.36 | 1.3 | 3.4 | 0.02 | 0.002 | 0.02 | 0.004 | 0.072 | 0.0006 | | 795 | 278 | Conforming steel |
| K | 0.31 | 0.6 | 3.0 | 0.01 | 0.002 | 0.04 | 0.004 | 0.021 | 0.0046 | | 765 | 315 | Conforming steel |
| L | 0.30 | 0.6 | 3.1 | 0.02 | 0.002 | 0.03 | 0.005 | 0.023 | 0.0018 | | 768 | 317 | Conforming steel |
| M | 0.34 | 0.4 | 2.7 | 0.01 | 0.001 | 0.03 | 0.004 | 0.029 | 0.0009 | | 759 | 311 | Conforming steel |
| N | 0.20 | 0.3 | 2.7 | 0.01 | 0.001 | 0.02 | 0.004 | 0.026 | 0.0023 | Nb: 0.014, Cr: 0.01 | 777 | 377 | Conforming steel |
| O | 0.25 | 0.9 | 2.9 | 0.02 | 0.002 | 0.04 | 0.004 | 0.018 | 0.0021 | Mo: 0.06, Cr: 0.06, Zr: 0.01 | 800 | 345 | Conforming steel |
| P | 0.26 | 1.4 | 2.9 | 0.01 | 0.001 | 0.03 | 0.005 | 0.023 | 0.0018 | Ca: 0.0028, V: 0.011, W: 0.009 | 810 | 342 | Conforming steel |
| Q | 0.19 | 0.3 | 2.2 | 0.02 | 0.002 | 0.04 | 0.004 | 0.015 | 0.0019 | Cu: 0.15, Ni: 0.09, Mg: 0.0008 | 805 | 397 | Conforming steel |
| R | 0.27 | 0.8 | 1.9 | 0.01 | 0.002 | 0.04 | 0.004 | 0.010 | 0.0008 | Sb: 0.006, Sn: 0.004, REM: 0.0003 | 810 | 370 | Conforming steel |
| S | 0.10 | 0.8 | 2.2 | 0.01 | 0.001 | 0.03 | 0.004 | 0.024 | 0.0020 | | 844 | 441 | Comparative steel |
| T | 0.46 | 0.3 | 2.0 | 0.02 | 0.002 | 0.04 | 0.004 | 0.019 | 0.0024 | | 763 | 277 | Comparative steel |
| U | 0.31 | 1.7 | 1.9 | 0.01 | 0.002 | 0.03 | 0.003 | 0.020 | 0.0031 | | 843 | 351 | Comparative steel |
| V | 0.14 | 0.8 | 1.5 | 0.01 | 0.002 | 0.01 | 0.005 | 0.018 | 0.0023 | | 843 | 445 | Comparative steel |
| W | 0.21 | 0.8 | 3.7 | 0.01 | 0.002 | 0.01 | 0.005 | 0.018 | 0.0023 | | 760 | 339 | Comparative steel |
| X | 0.25 | 1.3 | 2.9 | 0.06 | 0.001 | 0.04 | 0.003 | 0.023 | 0.0014 | | 847 | 347 | Comparative steel |
| Y | 0.15 | 0.8 | 3.0 | 0.01 | 0.011 | 0.03 | 0.005 | 0.012 | 0.0013 | | 801 | 391 | Comparative steel |
| Z | 0.33 | 0.2 | 3.3 | 0.01 | 0.002 | 1.01 | 0.004 | 0.010 | 0.0021 | | 1118 | 296 | Comparative steel |
| AA | 0.23 | 1.2 | 2.2 | 0.01 | 0.001 | 0.03 | 0.011 | 0.028 | 0.0026 | | 830 | 379 | Comparative steel |
| AB | 0.15 | 0.9 | 2.8 | 0.02 | 0.001 | 0.04 | 0.005 | 0 | 0.0025 | | 818 | 398 | Comparative steel |
| AC | 0.36 | 0.4 | 2.8 | 0.01 | 0.002 | 0.03 | 0.004 | 0.085 | 0.0017 | | 775 | 298 | Comparative steel |
| AD | 0.14 | 1.2 | 3.0 | 0.02 | 0.001 | 0.02 | 0.003 | 0.024 | 0 | | 829 | 396 | Comparative steel |
| AE | 0.19 | 1.4 | 0.8 | 0.01 | 0.001 | 0.03 | 0.004 | 0.013 | 0.0058 | | 884 | 445 | Comparative steel |

* 0 indicates no addition.

TABLE 2

| Steel | | Hot rolling | | | | Heat treatment | | | |
|---|---|---|---|---|---|---|---|---|---|
| | | | Cooling | | | | | Primary cooling | |
| sheet No. | Slab No. | Rolling finish temp. [° C.] | stop temp. (*4) [° C.] | Holding temp. (*5) [° C.] | Coiling temp. [° C.] | Soaking treatment Temp. [° C.] | Soaking treatment Time [s] | Start temp [° C.] | Cooling rate (*1) [° C./s] |
| 1 | A | 911 | 686 | 630 | 588 | 870 | 470 | 780 | 1100 |
| 2 | B | 873 | 665 | 598 | 538 | 800 | 310 | 690 | 1100 |
| 3 | C | 914 | 642 | 591 | 549 | 900 | 550 | 690 | 900 |
| 4 | D | 882 | 645 | 605 | 569 | 850 | 540 | 720 | 900 |
| 5 | E | 842 | 650 | 608 | 575 | 830 | 360 | 700 | 20 |
| 6 | F | 907 | 695 | 663 | 632 | 850 | 260 | 730 | 800 |
| 7 | G | 898 | 624 | 579 | 513 | 870 | 560 | 740 | 900 |
| 8 | H | 897 | 668 | 634 | 591 | 1050 | 430 | 700 | 40 |
| 9 | I | 879 | 719 | 676 | 608 | 790 | 310 | 700 | 1000 |
| 10 | J | 925 | 635 | 563 | 504 | 810 | 460 | 700 | 100 |
| 11 | K | 865 | 681 | 603 | 540 | 800 | 480 | 720 | 100 |
| 12 | L | 927 | 621 | 548 | 497 | 780 | 330 | 700 | 1000 |
| 13 | M | 905 | 644 | 588 | 559 | 780 | 520 | 690 | 1100 |
| 14 | N | 899 | 666 | 597 | 573 | 790 | 320 | 720 | 1200 |
| 15 | O | 925 | 717 | 655 | 591 | 830 | 360 | 720 | 1000 |
| 16 | P | 848 | 689 | 648 | 582 | 830 | 440 | 680 | 1000 |
| 17 | Q | 939 | 712 | 668 | 644 | 840 | 540 | 720 | 1000 |
| 18 | R | 881 | 633 | 576 | 520 | 830 | 360 | 740 | 1100 |
| 19 | S | 860 | 621 | 566 | 500 | 870 | 370 | 710 | 1000 |
| 20 | T | 878 | 690 | 628 | 571 | 780 | 550 | 760 | 900 |
| 21 | U | 928 | 674 | 596 | 569 | 880 | 320 | 700 | 1000 |
| 22 | V | 946 | 633 | 562 | 510 | 800 | 390 | 710 | 15 |
| 23 | W | 879 | 711 | 635 | 574 | 860 | 460 | 740 | 1100 |
| 24 | X | 916 | 698 | 621 | 589 | 860 | 320 | 720 | 1300 |
| 25 | Y | 860 | 676 | 615 | 566 | 1130 | 450 | 800 | 1100 |
| 26 | Z | 905 | 679 | 613 | 560 | 860 | 280 | 780 | 900 |
| 27 | AA | 934 | 652 | 600 | 568 | 820 | 460 | 710 | 1200 |
| 28 | AB | 900 | 654 | 611 | 563 | 810 | 460 | 720 | 1000 |

TABLE 2-continued

| | | | | | | | | | |
|---|---|---|---|---|---|---|---|---|---|
| 29 | AC | 923 | 637 | 563 | 527 | 850 | 350 | 690 | 1000 |
| 30 | AD | 915 | 621 | 578 | 525 | 910 | 570 | 700 | 1000 |
| 31 | AE | 902 | 708 | 650 | 590 | 860 | 410 | 740 | 1000 |
| 32 | F | 893 | 666 | 617 | 576 | 800 | 410 | 700 | 1000 |
| 33 | F | 928 | 674 | 619 | 571 | 850 | 190 | 780 | 900 |
| 34 | F | 934 | 647 | 577 | 545 | 870 | 280 | 660 | 1000 |
| 35 | I | 895 | 656 | 614 | 558 | 860 | 320 | 710 | 5 |
| 36 | I | 865 | 643 | 592 | 542 | 780 | 500 | 710 | 900 |
| 37 | I | 864 | 700 | 620 | 588 | 800 | 370 | 730 | 1100 |
| 38 | I | 911 | 643 | 606 | 568 | 790 | 480 | 730 | 900 |
| 39 | I | 933 | 708 | 631 | 582 | 790 | 290 | 750 | 1200 |
| 40 | L | 874 | 678 | 599 | 548 | 790 | 460 | 690 | 900 |
| 41 | L | 923 | 696 | 625 | 578 | 800 | 440 | 740 | 1000 |

| | Heat treatment | | | | | |
|---|---|---|---|---|---|---|
| | Secondary cooling | | | | | |
| Steel sheet No. | Cooling rate (*2) [° C./s] | Water flux density [m³/m²/min] | Tertiary cooling Cooling rate (*3) [° C./s] | Reheating Temp. [° C.] | Reheating Time [s] | Remarks |
| 1 | 290 | 4.6 | 180 | 196 | 600 | Example |
| 2 | 180 | 2.0 | 80 | 268 | 800 | Example |
| 3 | 170 | 1.9 | 220 | 200 | 600 | Example |
| 4 | 230 | 3.1 | 210 | 198 | 700 | Example |
| 5 | 120 | 1.2 | 120 | 160 | 700 | Example |
| 6 | 140 | 1.8 | 270 | 193 | 700 | Example |
| 7 | 330 | 4.8 | 190 | 174 | 1100 | Example |
| 8 | 380 | 5.1 | 200 | 212 | 1100 | Example |
| 9 | 270 | 3.5 | 250 | 185 | 1200 | Example |
| 10 | 260 | 3.3 | 170 | 288 | 600 | Example |
| 11 | 300 | 4.1 | 130 | 195 | 700 | Example |
| 12 | 200 | 2.4 | 160 | 221 | 1100 | Example |
| 13 | 270 | 3.4 | 290 | 198 | 1300 | Example |
| 14 | 290 | 4.0 | 280 | 190 | 900 | Example |
| 15 | 170 | 2.2 | 200 | 172 | 1200 | Example |
| 16 | 230 | 2.7 | 140 | 193 | 1300 | Example |
| 17 | 310 | 4.3 | 140 | 214 | 600 | Example |
| 18 | 300 | 4.3 | 230 | 200 | 800 | Example |
| 19 | 330 | 4.5 | 240 | 179 | 600 | Comparative example |
| 20 | 220 | 3.3 | 260 | 168 | 1000 | Comparative example |
| 21 | 190 | 2.3 | 320 | 203 | 1100 | Comparative example |
| 22 | 220 | 2.8 | 180 | 268 | 900 | Comparative example |
| 23 | 180 | 2.5 | 170 | 167 | 500 | Comparative example |
| 24 | 330 | 4.6 | 110 | 189 | 1000 | Comparative example |
| 25 | 190 | 3.3 | 150 | 152 | 480 | Comparative example |
| 26 | 270 | 4.3 | 210 | 218 | 700 | Comparative example |
| 27 | 200 | 2.5 | 210 | 196 | 1200 | Comparative example |
| 28 | 310 | 4.3 | 140 | 293 | 700 | Comparative example |
| 29 | 280 | 3.5 | 210 | 211 | 800 | Comparative example |
| 30 | 220 | 2.7 | 230 | 268 | 1300 | Comparative example |
| 31 | 310 | 4.5 | 210 | 189 | 500 | Comparative example |
| 32 | 312 | 4.1 | 211 | 189 | 500 | Comparative example |
| 33 | 270 | 4.3 | 100 | 208 | 600 | Comparative example |
| 34 | 350 | 4.3 | 260 | 282 | 1200 | Comparative example |
| 35 | 290 | 3.9 | 150 | 213 | 1200 | Comparative example |
| 36 | 50 | 0.4 | 200 | 186 | 1200 | Comparative example |
| 37 | 120 | 1.5 | 30 | 268 | 1300 | Comparative example |
| 38 | 260 | 3.6 | 160 | 126 | 600 | Example |
| 39 | 270 | 4.0 | 240 | 311 | 1300 | Example |
| 40 | 370 | 4.9 | 120 | 207 | 10 | Example |
| 41 | 240 | 3.4 | 260 | 230 | 1600 | Example |

(*1) Average cooling rate in the temperature range from the cooling start temperature to Ms point (*2) Average cooling rate in the temperature range from Ms point to temperature of (Ms point - 50° C.)

(*3) Average cooling rate to 50° C. or lower (*4) Temperature reached within 3 s from rolling finish temperature (*5) Held at this temperature for 5 s or more

TABLE 3

| Steel sheet No. | Slab No. | Hot rolling: Rolling finish temp. [° C.] | Cooling: stop temp. (*4) [° C.] | Cooling: Holding temp. (*5) [° C.] | Coiling temp. [° C.] | Heat treatment: Soaking treatment Temp. [° C.] | Soaking treatment Time [s] | Primary cooling: Start temp. [° C.] | Primary cooling: Cooling rate (*1) [° C./s] | Secondary cooling: Cooling rate (*2) [° C./s] | Secondary cooling: Water flux density [m³/m²/min] | Tertiary cooling: Cooling rate (*3) [° C./s] | Reheating Temp. | Reheating Time [s] | Remarks |
|---|---|---|---|---|---|---|---|---|---|---|---|---|---|---|---|
| 42 | L | 880 | 680 | 630 | 570 | 860 | 500 | 700 | 1100 | 230 | 2.9 | 190 | 184 | 900 | Example |
| 43 | L | 870 | 620 | 570 | 520 | 860 | 520 | 700 | 1100 | 240 | 3.0 | 190 | 188 | 900 | Example |

(*1) Average cooling rate in the temperature range from the cooling start temperature to Ms point
(*2) Average cooling rate in the temperature range from Ms point to temperature of (Ms point - 50° C.)
(*3) Average cooling rate to 50° C. or lower
(*4) Temperature reached within 3 s from rolling finish temperature
(*5) Held at this temperature for 5 s or more The resulting steel sheets were quantified for metallic structure and further evaluated for tensile properties and press formability. The results are listed in Table 4.

To quantify metallic structure, an L-section (vertical section parallel to the rolling direction) of each steel sheet was polished and corroded with nital, then observed with a scanning electron microscope (SEM) at ¼ of the thickness from the steel sheet surface (hereafter referred to as a ¼ thickness position) in 4 fields of view at 2,000× magnification, and measurement was made by image analysis of the micrographs taken. In this case, martensite and bainite correspond to the gray-colored microstructures in the SEM observations. On the other hand, ferrite corresponds to a region that assumed black contrast in SEM. Note that martensite and bainite contain trace amounts of carbides, nitrides, sulfides, and oxides inside, but since it is difficult to exclude these, the area fraction of the region including them was used as its area fraction.

Retained austenite (γ) was measured by the X-ray diffraction intensity analysis on the surface of each steel sheet after 200 μm of the surface layer was removed by chemical polishing with oxalic acid. The measurements were obtained by calculation from the integrated intensity of the (200)α, (211)α, (220)α, (200)γ, (220)γ, and (311)γ diffraction plane peaks measured using the Mo—$K_\alpha$ line.

Martensite and bainite can be distinguished by observing the position and variants of the carbides in the interior by SEM at 10,000× magnification. That is, in bainite, since carbides are formed at the interface of a lath-like structure or within laths and the crystal orientation relationship between bainitic ferrite and cementite is one type, the carbides formed extend in a single direction. On the other hand, in martensite, since carbides are formed within laths and there are two or more types of crystal orientation relationship between laths and carbides, the carbides formed extend in multiple directions. In addition, bainite has a relatively high microstructural aspect ratio, and retained austenite (γ), which is thought to be formed by C enrichment, can be observed as a white contrast between the laths.

The length of a sub-block boundary, $L_S$, and the length of a block boundary, $L_B$, were measured according to the following method. An L-section of each steel sheet was polished and then finish polished with colloidal silica, and a 200 μm×200 μm region was analyzed by electron backscattered diffraction (EBSD) at a ¼ thickness position from the steel sheet surface. The obtained crystal orientation data were analyzed using analysis software (OIM Analysis Ver. 7) available from TSL Solutions, Inc. The step size was set to 0.2 μm. Since ferrite, bainite, and martensite have the same body-centered cubic (BCC) structure, it is difficult to distinguish between them on the crystal orientation map by EBSD, and since the steels according to the present disclosure are martensite-dominant, the orientation relationship in crystal grain boundaries was quantified for those regions with a BCC structure including these microstructures. Block boundaries were defined as locations where the crystal orientation difference between adjacent steps was 15 degrees or more, and sub-block boundaries were defined as locations where the crystal orientation difference between adjacent steps was 3 degrees or more and less than 15 degrees. The length of each boundary (length of block boundary $L_B$ and length of sub-block boundary $L_S$) was automatically measured when the boundary was drawn on the analysis software described above.

The standard deviation of Mn concentration was determined as follows. After mirror polishing an L-section of each steel sheet, a 300 μm×300 μm region, ranging from a ⅜ thickness position to a ⅝ thickness position of the steel sheet, was analyzed using an electron probe microanalyzer (EPMA). The accelerating voltage was 15 kV, the beam diameter was 1 μm, and the beam current was $2.5\times10^{-6}$ A. The standard deviation was calculated from the obtained 300×300 quantitative values of Mn.

For tensile test, a JIS No. 5 tensile test specimen was cut from each steel sheet with the transverse direction (direction orthogonal to the rolling direction) as the longitudinal direction, and tensile test (in accordance with JIS Z2241) was performed to evaluate tensile strength. The steel sheets with tensile strength of 1310 MPa or more were considered acceptable.

Press formability was evaluated by the punch stretch forming test, which was correlated with the actual press formability evaluation test using model parts. The punch stretch formability is known to correlate with indices such as elongation properties and n-values in tensile tests. Martensitic-dominant steel targeted by the present disclosure has low ductility, and it is presumed that its superiority can be evaluated in more complex forming tests, even if the tensile test results do not show any superiority. For the punch stretch forming test, a 210 mm×210 mm sample sheet was cut from each steel sheet and punched with a 100 mmφ punch. The blank holder was set to 100 tonnes, the feed rate was set to 30 mm/min, and R352L was applied as lubricant. The maximum dome height at the time of cracking was evaluated with N=5 and the average value obtained was used as the punch stretch forming height. The sample sheets with punch stretch forming height of 19.5 mm or more were considered acceptable.

TABLE 4

| Steel sheet No. | Slab No. | Metallic structure: Area ratio of martensite [%] | Area ratio of remainder [%] | $L_S/L_B \times [C\ \%]^{0.8}$ | Standard deviation of Mn concentration [%] | Tensile strength [MPa] | Punch stretch forming height [mm] | Remarks |
|---|---|---|---|---|---|---|---|---|
| 1 | A | 98 | 2 | 0.12 | 0.31 | 1337 | 22.6 | Example |
| 2 | B | 92 | 8 | 0.10 | 0.25 | 2098 | 19.8 | Example |
| 3 | C | 86 | 14 | 0.11 | 0.19 | 1610 | 21.4 | Example |
| 4 | D | 86 | 14 | 0.11 | 0.19 | 1439 | 22.1 | Example |
| 5 | E | 95 | 5 | 0.09 | 0.40 | 1824 | 20.7 | Example |
| 6 | F | 91 | 9 | 0.10 | 0.23 | 1513 | 21.5 | Example |
| 7 | G | 92 | 8 | 0.12 | 0.20 | 1683 | 22.3 | Example |
| 8 | H | 95 | 5 | 0.12 | 0.38 | 1901 | 21.1 | Example |
| 9 | I | 91 | 9 | 0.12 | 0.33 | 1514 | 22.1 | Example |
| 10 | J | 97 | 3 | 0.10 | 0.38 | 2109 | 19.8 | Example |
| 11 | K | 95 | 5 | 0.11 | 0.31 | 1948 | 21.0 | Example |
| 12 | L | 93 | 7 | 0.10 | 0.33 | 1899 | 20.3 | Example |
| 13 | M | 90 | 10 | 0.11 | 0.27 | 2021 | 20.6 | Example |
| 14 | N | 91 | 9 | 0.12 | 0.27 | 1594 | 22.0 | Example |
| 15 | O | 94 | 6 | 0.10 | 0.30 | 1798 | 21.0 | Example |
| 16 | P | 91 | 9 | 0.11 | 0.30 | 1854 | 21.0 | Example |
| 17 | Q | 89 | 11 | 0.12 | 0.22 | 1479 | 22.2 | Example |
| 18 | R | 91 | 9 | 0.12 | 0.20 | 1769 | 21.6 | Example |
| 19 | S | 87 | 13 | 0.13 | 0.22 | 1295 | 23.2 | Comparative example |
| 20 | T | 95 | 5 | 0.10 | 0.20 | 2378 | 17.2 | Comparative example |
| 21 | U | 90 | 10 | 0.10 | 0.20 | 1948 | 18.4 | Comparative example |
| 22 | V | 82 | 18 | 0.12 | 0.18 | 1302 | 21.8 | Comparative example |
| 23 | W | 99 | 1 | 0.10 | 0.44 | 1704 | 18.4 | Comparative example |
| 24 | X | 95 | 5 | 0.12 | 0.30 | 1800 | 17.8 | Comparative example |
| 25 | Y | 100 | 0 | 0.11 | 0.31 | 1325 | 18.6 | Comparative example |
| 26 | Z | 100 | 0 | 0.11 | 0.36 | 1894 | 18.0 | Comparative example |
| 27 | AA | 90 | 10 | 0.11 | 0.22 | 1728 | 19.1 | Comparative example |
| 28 | AB | 78 | 22 | 0.12 | 0.28 | 1023 | 22.3 | Comparative example |
| 29 | AC | 91 | 9 | 0.11 | 0.28 | 2077 | 17.7 | Comparative example |
| 30 | AD | 82 | 18 | 0.11 | 0.31 | 1158 | 21.8 | Comparative example |
| 31 | AE | 86 | 14 | 0.13 | 0.18 | 1567 | 19.4 | Comparative example |
| 32 | F | 62 | 38 | 0.12 | 0.23 | 1282 | 22.9 | Comparative example |
| 33 | F | 75 | 25 | 0.12 | 0.23 | 1300 | 22.4 | Comparative example |
| 34 | F | 74 | 26 | 0.12 | 0.23 | 1201 | 22.3 | Comparative example |
| 35 | I | 65 | 35 | 0.12 | 0.23 | 1212 | 22.7 | Comparative example |
| 36 | I | 92 | 8 | 0.05 | 0.33 | 1520 | 18.9 | Comparative example |
| 37 | I | 94 | 6 | 0.10 | 0.33 | 1302 | 21.0 | Comparative example |
| 38 | I | 94 | 6 | 0.11 | 0.33 | 1607 | 20.2 | Example |
| 39 | I | 96 | 4 | 0.12 | 0.33 | 1344 | 20.5 | Example |
| 40 | L | 92 | 8 | 0.12 | 0.33 | 1960 | 19.5 | Example |
| 41 | L | 97 | 3 | 0.11 | 0.33 | 1871 | 19.6 | Example |
| 42 | L | 93 | 7 | 0.10 | 0.33 | 1894 | 20.9 | Example |
| 43 | L | 93 | 7 | 0.11 | 0.24 | 1889 | 22.2 | Example |

As can be seen from Table 4, those steels for which the compositions and heat treatment conditions were controlled properly had tensile strength of 1310 MPa or more and excellent press formability.

Figure 2:
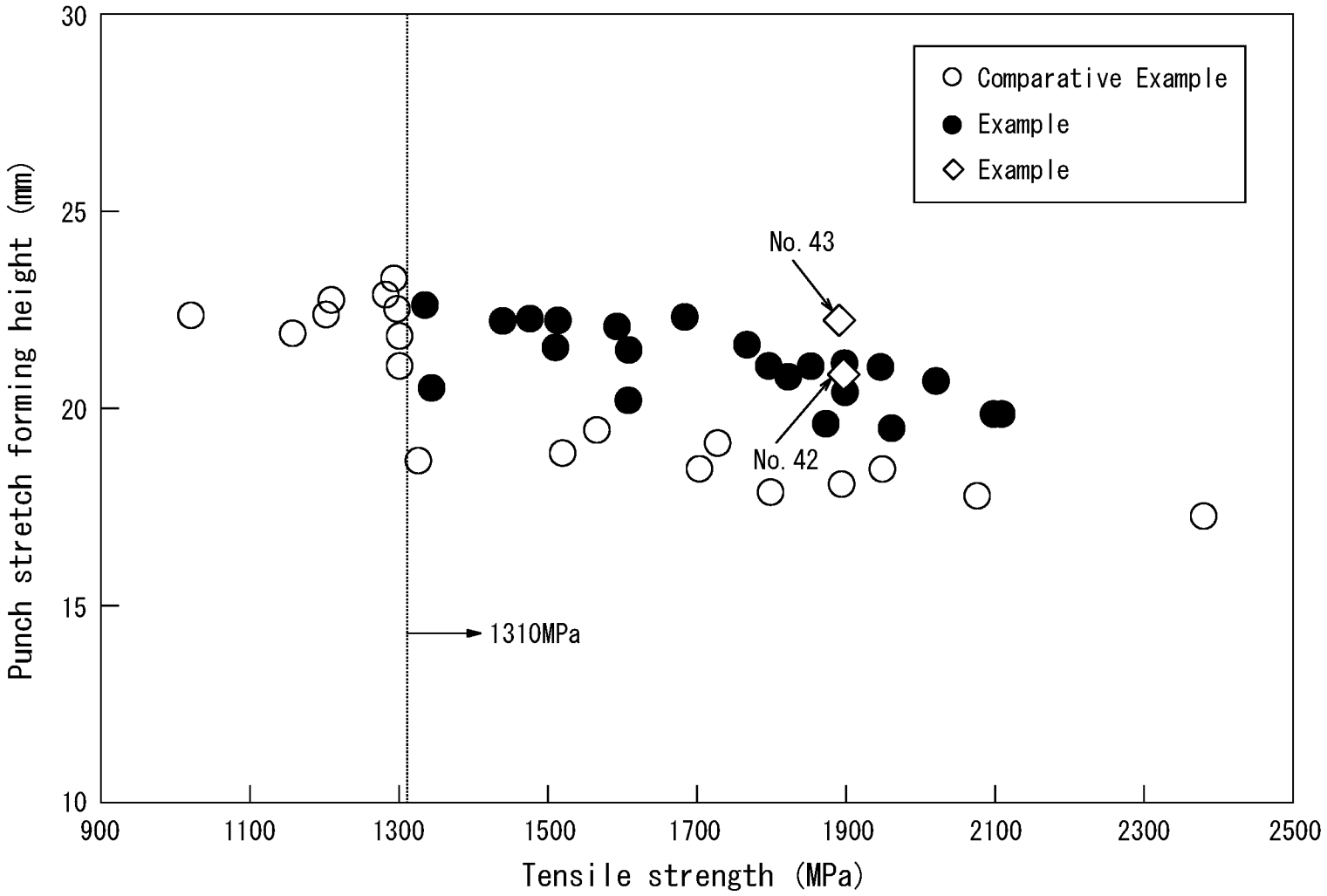
FIG. 2 is a graph illustrating the tensile strength and the punch stretch forming height in examples.

In this respect, FIG. 2 illustrates the evaluation results of the cases (our examples and comparative examples), organized with tensile strength on the horizontal axis and punch stretch forming height on the vertical axis. As can be seen from FIG. 2, all of our examples simultaneously satisfy a tensile strength of 1310 MPa or more and a punch stretch forming height of 19.5 mm or more. In particular, a comparison of formability at the same strength demonstrates that formability was significantly improved in our examples. A comparison of No. 42 (our example) and No. 43 (our example) demonstrates that both gave good results, and it is possible to further improve the press formability by optimizing the hot rolling process to suppress Mn segregation.

Example 2

A galvanized steel sheet that was obtained by subjecting No. 1 (our example) in Table 4 of Example 1 to galvanizing treatment was press-formed to produce a first member according to the present disclosure. Furthermore, the galvanized steel sheet obtained by subjecting No. 1 (our example) in Table 4 of Example 1 to galvanizing treatment and another galvanized steel sheet obtained by subjecting No. 7 (our example) in Table 4 of Example 1 to galvanizing treatment were joined by spot welding to produce a second member according to the present disclosure. The punch stretch forming heights for these first and second members were measured as described above and determined to be 20.8 mm and 21.2 mm, respectively. In other words, both the first and second members had excellent press formability.

Similarly, the steel sheet No. 1 (our example) in Table 4 of Example 1 was press-formed to produce a third member according to the present disclosure. Furthermore, the steel sheet No. 1 (our example) in Table 4 of Example 1 and another steel sheet No. 7 (our example) in Table 4 of Example 1 were joined by spot welding to produce a fourth member according to the present disclosure. The punch stretch forming heights for these third and fourth members were measured as described above and determined to be 21.3 mm and 21.5 mm, respectively. In other words, both the third and fourth members had excellent press formability.

The invention claimed is:

1. A steel sheet comprising:

a chemical composition containing, by mass %,

C: 0.12% or more and 0.40% or less,

Si: 1.5% or less,

Mn: more than 1.7% and 3.2% or less,

P: 0.05% or less,

S: 0.010% or less, sol. Al: 1.00% or less,

N: 0.010% or less,

Ti: 0.002% or more and 0.080% or less, and

B: 0.0002% or more and 0.0050% or less, and optionally further containing, by mass %, at least one selected from the group consisting of Cu: 0.01% or more and 1.00% or less, Ni: 0.01% or more and 1.00% or less, Mo: 0.005% or more and 0.350% or less, Cr: 0.005% or more and 0.350% or less, Zr: 0.005% or more and 0.350% or less, Ca: 0.0002% or more and 0.0050% or less, Nb: 0.002% or more and 0.060% or less, V: 0.005% or more and 0.500% or less, W: 0.005% or more and 0.200% or less, Sb: 0.001% or more and 0.100% or less, Sn: 0.001% or more and 0.100% or less, Mg: 0.0002% or more and 0.0100% or less, and REM: 0.0002% or more and 0.0100% or less with the balance being Fe and inevitable impurities;

a metallic structure in which an area ratio of martensite to an entire microstructure is 85% or more, and a ratio $L_S/L_B$ satisfies formula (1), where $L_S$ denotes a length of a sub-block boundary and $L_B$ denotes a length of a block boundary:

$$0.06/[C\ \%]^{0.8} \leq L_S/L_B \leq 0.13/[C\ \%]^{0.8} \quad (1),$$

where [C %] represents a C content in mass %;

a tensile strength of 1683 MPa or more, and the Mn has a standard deviation of concentration of 0.24% or less.

2. The steel sheet according to claim 1, comprising a galvanized layer on a surface thereof.

3. A member obtainable by subjecting the steel sheet as recited in claim 1 to at least one of forming or welding.

4. A method for producing the steel sheet according to claim 1, comprising:

subjecting a steel material having the chemical composition as recited in claim 1 to hot rolling to obtain a hot-rolled steel sheet, and then subjecting the hot-rolled steel sheet to cold rolling to obtain a cold-rolled steel sheet; and subjecting the cold-rolled steel sheet to soaking treatment at or above $Ac_3$ point for 240 seconds or more, followed by primary cooling in which the cold-rolled steel sheet is cooled at an average cooling rate of 10° C./s or higher and 1500° C./s or lower in a temperature range from a cooling start temperature of 680° C. or higher to Ms point, followed by secondary cooling in which the cold-rolled steel sheet is cooled at an average cooling rate of 240° C./s or higher and 330° C./s or lower in a temperature range from the Ms point to a temperature of (the Ms point—50° C.), followed by tertiary cooling in which the cold-rolled steel sheet is cooled to a temperature of 50° C. or lower at an average cooling rage of 70° C./s or higher and 230° C./s or lower, wherein optionally, after the tertiary cooling, reheating is performed in which the cold-rolled steel sheet is held in a temperature range from 150° C. to 300° C. for 20 seconds to 1500 seconds, when the reheating is performed, optionally, coating or plating treatment is performed after the reheating, and optionally, the secondary cooling uses water as a refrigerant and has a water flux density of 0.5 $m^3/m^2$/min or more and 10.0 $m^3/m^2$/min or less, wherein the hot rolling includes rolling the steel material at a rolling finish temperature of 840° C. or higher, then cooling the steel material to a temperature of 640° C. or lower within 3 seconds, then holding the steel material in a temperature range from 600° C. to 500° C. for 5 seconds or more, and then coiling the steel material at a temperature of 550° C. or lower.

5. A method for producing a member, comprising subjecting the steel sheet produced by the method as recited in claim 4 to at least one of forming or welding.

6. A member obtainable by subjecting the steel sheet as recited in claim 2 to at least one of forming or welding.

* * * * *